US005290388A

United States Patent [19]

Zepf

[11] Patent Number: 5,290,388

[45] Date of Patent: Mar. 1, 1994

[54] LABELLING MACHINE

[75] Inventor: Georg Zepf, Hagelstadt, Fed. Rep. of Germany

[73] Assignee: Krones AG Hermann Kronseder Maschinenfabrik, Neutraubling, Fed. Rep. of Germany

[21] Appl. No.: 938,221

[22] PCT Filed: Aug. 9, 1991

[86] PCT No.: PCT/EP91/01522

§ 371 Date: Oct. 14, 1992

§ 102(e) Date: Oct. 14, 1992

[87] PCT Pub. No.: WO92/02419

PCT Pub. Date: Feb. 20, 1992

[30] Foreign Application Priority Data

Aug. 10, 1990 [DE] Fed. Rep. of Germany ..... 4025410

[51] Int. Cl.[5] ..... B65C 9/00

[52] U.S. Cl. ..... 156/447; 156/448; 156/566; 156/DIG. 26; 156/DIG. 27

[58] Field of Search ..... 156/447, 566, DIG. 11, 156/DIG. 13, DIG. 26, DIG. 27, 567, 571, 448, 449

[56] References Cited

U.S. PATENT DOCUMENTS 4,545,832 10/1985 Hoffmann ..... 156/447 X 4,594,123 6/1986 Eder ..... 156/567 X

FOREIGN PATENT DOCUMENTS

3025178A1 1/1982 Fed. Rep. of Germany .

3308489A1 9/1984 Fed. Rep. of Germany .

3823471A1 1/1990 Fed. Rep. of Germany .

*Primary Examiner*—David A. Simmons

*Assistant Examiner*—James J. Engel, Jr.

*Attorney, Agent, or Firm*—Finnegan, Henderson, Farabow, Garrett & Dunner

[57] ABSTRACT

In a labelling machine comprising at least one plate (1), which is adapted to carry out controlled rotations, and a plunger (2), which is adapted to carry out controlled upward and downward movements, the object to be labelled, e.g. a bottle (24), being fixed between said plate and said plunger such that it is secured against rotation relative thereto, the plunger has associated therewith a rotating means (3), which will rotate said plunger to a specific angular position and/or fix it in said angular position, if the plunger is not in contact with the object to be labelled. However, if the plunger is in contact with the object to be labelled, it will be decoupled from said rotating means, whereupon it can rotate freely together with the object to be labelled, which is driven by the plate. Such a rotating means can be established with the aid of simple structural means and permits a manifold use of asymmetric plungers having a preferred position. This is the case e.g. with plungers having contact surfaces for projecting labels, plungers having recesses for turning down projecting label ends, and plungers equipped with gripping fingers for the labels etc.

7 Claims, 2 Drawing Sheets

LABELLING MACHINE

DESCRIPTION

Figure 1:
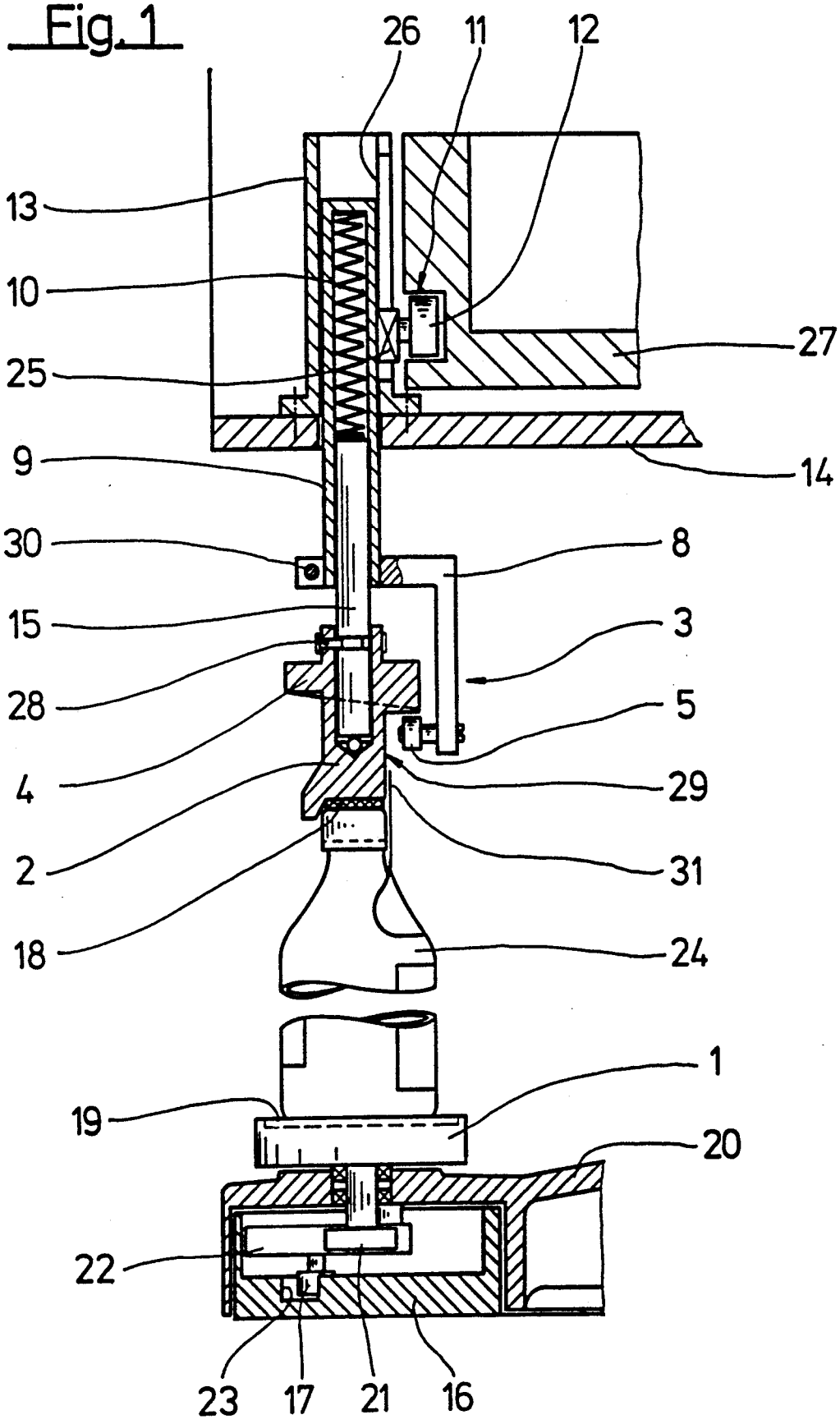

The present invention refers to a labelling machine.

In the case of labelling machines, e.g. for bottles, glass jars and vessels, receptacles etc., it is common practice to subject, with the aid of a control means, the plates to specific rotary motions and rotary positions in the course of the labelling process, said rotary motions and positions being transmitted by frictional or positive engagement to the objects to be labelled, which are pressed onto the plates by the plungers and which, in turn, entrain said plungers which are supported in a freely rotatable manner. In cases of use in which the angular position of the plunger does not have any influence on the labelling process, this is absolutely unproblematic.

There are, however, also cases of use in which the angular position of the plunger during the labelling process has to be defined precisely. This is, for example, necessary when the plunger has on one side thereof a flattened contact surface for a label end projecting upwards beyond the object to be labelled, or is equipped with a controllable gripping finger for a label, or is provided with an opening permitting a label to be applied to the upper side of an object to be labelled, or when the surface of the object to be labelled which is seized by the plunger is eccentric with respect to the axis of rotation of the plate. In such cases, it is known to provide the plunger with a rotating means of its own. Such a labelling machine is described in German-Offenlegungsschrift 38 23 471.

The present invention deals with the problem of constructing in the case of a labelling machine according to the generic clause the rotating means, which is used for rotating the plungers, in a particularly simple and economy-priced manner.

In the case of a labelling machine according to the present invention, direct control of the plungers by the rotating means is only effected if said plungers are raised from the objects to be labelled, whereas indirect control of the plungers by means of the plates is effected if said plungers are pressed onto an object to be labelled. This permits a particularly simple and economy-priced structural design of the rotating means, and it is also easily possible to equip labelling machines which have already been delivered, subsequently with such a rotating means. Resetting of the rotating means will, in most cases, not be necessary, when the rotary program for the plates is changed; the rotating means mainly has to guarantee that the plunger will occupy a predetermined starting position, when it is applied to the vessel or the like. Complicated cam paths, which directly influence the plungers during the whole labelling process, can be dispensed with.

There are many possibilities of constructing the rotating means. The necessary starting position or neutral position of a plunger can, for example, be defined by two cooperating stop means in a very simple manner, one of said stop means being connected to the plunger and the other to the stationary part of the labelling machine. By means of a torsion spring acting on the plunger, the stop means are caused to engage as soon as the plunger has been raised from the object to be labelled. After having been applied to an object to be labelled, the plunger will then be entrained by said object against the force exerted by the torsion spring. In this case, the torsion spring of the rotating means will also be effective when the plunger has been applied to the object to be labelled, but a sufficiently weak dimensioning of said spring will guarantee that its force will easily be exceeded.

It will, however, be particularly expedient, when, in accordance with the further development of the invention, the rotating means is only effective as long as the plunger is not in contact with an object to be labelled. In this case, the plunger can rotate in the labelling area together with the object to be labelled completely unhindered without being obstructed by a torsion spring or the like.

On the basis of a further development, the necessary torque for returning the plunger to the neutral position defined by the recess can be adjusted by simple adaptation of the oblique ramp and of the force of the spring.

Further developments result in a rotating means having a particularly simple structural design and functioning in a reliable manner, said rotating means influencing the plunger only if said plunger is not in contact with the object to be labelled.

In order to guarantee that the plunger will be entrained by the object to be labelled, it will be expedient, when, in accordance with a further development of the invention, the plunger is provided with a friction facing acting on the object to be labelled.

Figure 2:
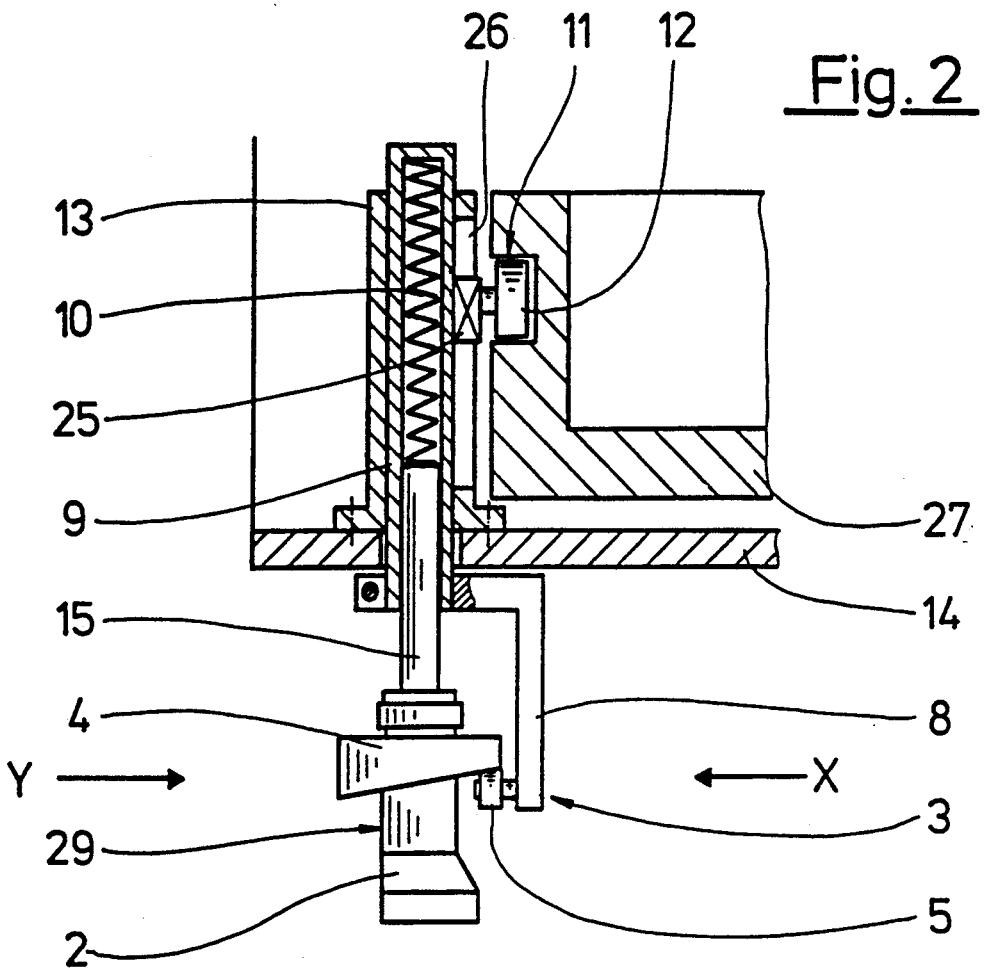
Figure 3:
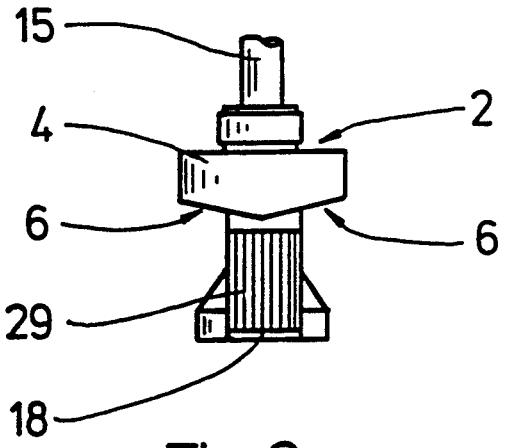
Figure 4:
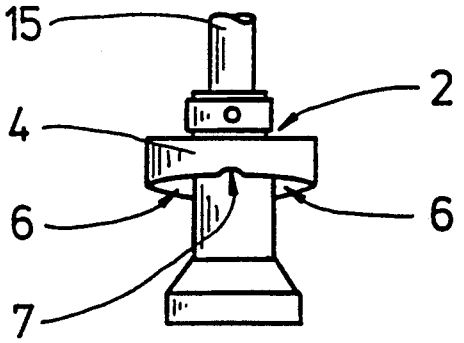

In the following, an embodiment of the present invention will be described in detail on the basis of the drawings, in which:

FIG. 1 shows a vertical fragmentary section through a labelling machine in the area of an object to be labelled, which has a plunger applied thereto, FIG. 2 shows the fragmentary section according to FIG. 1 in a condition in which the plunger has been raised from the object to be labelled, FIG. 3 shows the view Y according to FIG. 2, FIG. 4 shows the view X according to FIG. 2.

The labelling machine, only part of which is shown in FIG. 1 to 4, is equipped such that it can apply various labels to objects, in the form of bottles 24, which are to be provided with a label. The labelling machine includes a rotary table 20, which rotates about a vertical axis and in which a plurality of plates 1 having a vertical axis of rotation is supported, said plates 1 being uniformly distributed over the circumference of said rotary table 20. The plates 1 communicate via a pinion 21 with a toothed segment 22, which is pivotably supported on said rotary table 20 and which, in turn, engages via a cam roller 17 a closed groove path 23 formed in a stationary cam ring 16. On the basis of this arrangement, all plates 1 are subjected to programmed rotation and positioning, as required by the labelling operation, when the rotary table 20 is being rotated. In order to guarantee a reliable transmission of the rotation of the plate 1 to the bottle 24, a friction facing 19 is provided on the upper surface of the table 1.

A rotary head 14 is provided concentrically with and in spaced relationship with the rotary table 20, said rotary head 14 being connected to the rotary table 20 such that it is secured against rotation relative thereto and, consequently, it will rotate together with said rotary table 20. Pillow blocks 13 are secured to the rotary head 14, said pillow blocks being uniformly distributed over the circumference of said rotary head, one above each plate 1. Each pillow block 13 accommodates therein a cylindrical sleeve 9, which is closed at its upper end face and open at its lower end face and which is adapted to be vertically moved within said pillow block. A sliding block 25 and a rotatable cam roller 12 are secured to the inner side of the sleeve 9 facing the axis of the rotary head 14. In order to secure the sleeve 9 against rotation, the sliding block 25 is guided in a vertical slotted link 26 of the pillow block 13, whereas the cam roller 12 engages a closed, groove-shaped lifting cam path 11, which is formed in a stationary cam barrel 27. By means of said lifting cam path 11 and the cam rollers 12 following said lifting cam path, a control means is defined for controlling the lifting movement and the vertical level, respectively, of the sleeves 9.

A vertically extending rod 15 is supported in each sleeve 9 such that it is vertically movable therein, the upper end face of said rod 15 and the closed upper end face of the sleeve 9 having inserted between them a spring element 10 in the form of a biased pressure spring. This biased pressure spring tries to force the rod 15 downwards towards the plate 1 or rather a bottle 24 supported by said plate.

On the lower end of the rod 15 projecting beyond the sleeve 9, which, in turn, projects downwards beyond the rotary head 14, a plunger 2 is rotatably supported by means of a vertical, cylindrical bearing bore, a hardened ball being arranged between said lower end of the rod 15 and said plunger 2. The cylindrical upper part of the plunger 2 is provided with a cross hole in which a pin 28 is releasably held by means of a clamping spring. The pin 28 engages a complementary annular groove in the rod 15 with a certain amount of play, whereby said plunger 2 is releasably held on said rod 15. In the central portion of the plunger 2, a disklike cam path 4 is formed, which has a cylindrical circumferential surface and which will be described in detail hereinbelow. The lower part of the plunger 2 is constructed after the fashion of a centering bell and, on one side thereof, it is provided with a vertical, knurled flattened portion 29. The lower surface of the plunger 2 has secured thereto a friction facing 18 in the area which comes into contact with the bottle 24 or rather with the bottle cap. This will improve the transmission of the rotary movement from the bottle 24 to the plunger 2.

At the lower end of each sleeve 9, a holder 8 is adjustably clamped in position, which, in the upper portion thereof is constructed after the fashion of a horizontal, slotted clamp with an attachment screw 30 and which includes an arm projecting vertically downwards from said clamp up to and beyond the cam path 4. At the lower end of this arm, a rotatable roller 5 is arranged, which is located on a level between the cam path 4 and the plate 1. The roller 5, whose axis of rotation extends radially to the axis of rotation of the plunger 2, is arranged such that it can touch the outer rim of the lower end face of the cam path 4. This rim of the cam path 4 is constructed after the fashion of a one-sided lifting cam path and is provided with a recess 7 defining a preferred neutral position of the plunger 2, when it is in contact with said roller 5. This recess 7 is followed at both sides thereof by downwardly sloping ramps 6, which, defining a tip, meet at the opposite side of the cam path 4. Cooperating with the roller 5, the two ramps 6 guarantee that the plunger 2 will return to its neutral position.

The downwardly projecting arm of the holder 8 is arranged on the inner side of the sleeve 9 which faces the axis of rotation of the rotary table 20 so that the application of the lables, which is carried out from outside by labelling cylinders or the like (not shown), is not obstructed. In the case of the embodiment shown, the labels in question are a body label, a rear label and a neck label, which includes a strip 31 projecting upwards beyond the head of the bottle 24. When the label is being affixed to the bottle 24, this strip 31 is first positioned in contact with the flattened portion 29 of the plunger 2. In a discharge star, which is provided subsequent to the rotary table 20 and which is not shown, said strip 31 is then turned down by means of rollers or the like and pressed onto the upper side of the bottle cap.

In order to guarantee that the strip 31 will exactly be positioned on the knurled flattened portion 29, each plunger 2 has associated therewith a rotating means 3, which is essentially defined by the cam path 4, the roller 5 and the spring element 10. The function of this rotating means 3 is the following one:

In the bottle-free area of rotation of the rotary table 20 between the inlet station (not shown) and the discharging station (not shown either), the sleeve 9 with the holder 8 and the roller 5 is guided by means of the lifting cam path 11 in its upper end position shown in FIG. 2. In this position, the rod 15 with the plunger 2 is, unhindered, pressed downwards by means of the spring element 10 to such an extent that the lower rim of the cam path 4 will be in spring-loaded contact with the roller 5. If the roller 5 first comes into contact with one of the two oblique ramps 6, it will roll along said ramp until it comes into engagement with the recess 7. In the course of this process, the plunger 2 will be rotated clockwise or anticlockwise until it has reached its neutral position, the plunger being slightly lowered at the same time. If the roller 5 first comes into contact with the recess 7, no rotation of the plunger 2 will take place, said plunger 2 being then immediately fixed in its neutral position.

The above-described rotation and fixing of the plungers 2 is completely independent of the rotation of the plates 1, which stand still in the bottle-free area of rotation or which can also carry out a reverse rotation.

In the area of the inlet station, the sleeve 9 plus all the parts which are secured thereto or supported thereon is moved downwards by means of an adequate descent in the lifting cam path 11, the relative position shown in FIG. 2 being first maintained in the course of said downward movement, until the friction facing 18 of the plunger 2 comes into contact with the cap of the bottle 24. This will stop the vertical movement of the plunger. The lowering movement of the sleeve 9 is continued still further, whereby the spring element 10 will be compressed. This will have the effect that, on the one hand, a sufficiently large clamping force between the plate 1 and the plunger 2 will be produced even in the case of tolerances in the height of the bottles 24 and that, on the other hand, the roller 5 will be moved downwards and completely out of the range of action of the cam path 4 until the lower end position of the sleeve 9 with the holder 8 and the roller 5 has been reached, said lower end position being shown in FIG. 1. The plunger 2 will thus first remain in its neutral position and the bottle 24 will be clamped firmly between the plate 1 and the plunger 2. When the plate 1 now carries out its various rotations and positioning movements under the influence of the groove path 23 in the course of the labelling process, these rotations and positioning movements will be transmitted exactly to the bottle 24 and from said bottle to the plunger 2 with the aid of the friction facings 18 and 19. This will have the effect that, when the neck label is being applied, the strip 31 will be placed precisely onto the flattened portion 29 of the plunger 2 due to an adequate selection of the neutral position of said plunger. The rotary means 3 for the plunger 2 is ineffective as long as the plunger 2 is fixed on the level, which is shown in FIG. 1, by a bottle 24.

If a bottle 24 supported by a plate 1 breaks, the respective plunger 2 will move down immediately under the influence of the spring element 10 until the cam path 4 strikes against the roller 5, which is still held in the same position, whereby the plunger 2 will immediately be adjusted to its neutral position in the manner described hereinbefore. If a rotary plate 1 has not placed thereon any bottle 24 at all, the plunger 2 will remain fixed in its neutral position throughout its whole revolution through the labelling area.

In the area of the discharge station, the sleeves 9 are gradually raised, by means of an ascent in the lifting cam path 11, from the lower end position shown in FIG. 1 to the upper end position shown in FIG. 2. In the course of this movement, the plunger 2 will first remain on the bottle 24 under the influence of the spring element 10 until the roller 5 strikes against the lower rim of the cam path 4, whereupon also the plunger 2 will participate in the lifting motion. The possibly necessary rotation of the plunger 2 can now already begin, if the roller 5 first strikes against one of the two oblique ramps 6. It is thus guaranteed that, even in the case of high labelling machine throughputs, the plungers 2 certainly will have reached their neutral position, when they are placed onto a bottle 24 again. It is, of course, also possible to construct the groove path 23 in such a way that the plungers 2 will, normally, already occupy their neutral position, when they are raised from the bottles 24. In this case, the rotating means 3 will only become effective if bottles 24 break.

An adjustment of the neutral position of the plungers 2 can easily be effected by adjusting the holders 8 with the aid of the attachment screw 30. If the labelling machine is changed over for processing a different type of bottles, in the case of which normal normal, rotationally symmetrical plungers or centering bells are required, the holders 8 can perhaps be removed.

I claim:

1. A labelling machine comprising at least one plate (1) adapted to carry out controlled rotations and receiving thereon an object to be labelled and further comprising a plunger (2), which is adapted to carry out controlled upward and downward movements and which fixes the object to be labelled on said plate, said plunger having associated therewith a separate rotating means (3), characterized in that said rotating means (3) moves the plunger (2) to at least one predetermined angular position and holds it in said position if said plunger is not in contact with an object to be labelled, and releases the plunger (2) for rotation together with the object to be labelled, if said plunger is in contact with said object.

2. A labelling machine according to claim 1, characterized in that the rotating means (3) will only be effective as long as the plunger (2) is not in contact with an object to be labelled.

3. A labelling machine according to claim 1 or 2, characterized in that the rotating means (3) comprises a cam path (4) and a roller (5) adapted to be brought into contact with said cam path by means of the force of a spring, said cam path (4) including at least one oblique ramp (6) for rotating the plunger (2) and at least one recess (7) for fixing said plunger (2).

4. A labelling machine according to one of the claims 2 and 3, characterized in that the roller (5) is raised from the cam path (4), when the plunger (2) is being applied to the object to be labelled.

5. A labelling machine according to claim 4, characterized in that the cam path (4) is constructed as a one-sided lifting cam path and is rigidly connected to the plunger (2), whereas the roller (5) is supported on a holder (8), which is secured against rotation relative to the plunger (2).

6. A labelling machine according to claim 5, characterized in that the plunger (2) is adapted to be rotated by the cam path (4) and is accommodated in a sleeve (9) such that it is longtudinally displaceable therein, said sleeve (9) being, in turn, arranged such that it can carry out controlled upward and downward movements relative to the plate (1) and is secured against rotation, that a biased spring element (10), which urges the plunger (2) towards the plate (1), is inserted between said plunger (2) and the sleeve (9), and that the holder (8) is secured to the sleeve (9), and that the roller (5) is arranged in the area between the cam path (4) and the plate (1), the control means (11, 12) for the sleeve (9) being constructed such that, when the plunger (2) is applied to an object to be labelled, said sleeve (9) with the roller (5) is still moved towards the plate (1) at least to such an extent that the roller (5) will leave the range of action of the cam path (4).

7. A labelling machine according to one of the claims 1 to 6, characterized in that the surface of the plunger (2) which is brought into contact with the object to be labelled is provided with a friction facing (18).

* * * * *